US005170919A

United States Patent [19]

DeSantis et al.

[11] Patent Number: 5,170,919

[45] Date of Patent: * Dec. 15, 1992

[54] SIMULATED POUCH WITH INTERIOR, CONCEALED HOLSTER

[75] Inventors: Eugene DeSantis, 149 Denton Ave., New Hyde Park, N.Y. 11040; Mitchell Bloom, New Hyde Park, N.Y.

[73] Assignee: Eugene DeSantis, New Hyde Park, N.Y.

[ * ] Notice: The portion of the term of this patent subsequent to Oct. 30, 2007 has been disclaimed.

[21] Appl. No.: 603,396

[22] Filed: Oct. 26, 1990

Related U.S. Application Data

[63] Continuation of Ser. No. 435,172, Nov. 13, 1989, Pat. No. 4,966,320.

[51] Int. Cl.[5] ..... A45C 1/04

[52] U.S. Cl. ..... 224/229; 224/192; 224/196; 224/228; 224/238; 224/243; 224/901; 224/911

[58] Field of Search ..... 224/192, 196, 202, 224, 224/226, 227, 228, 229, 238, 242, 243, 250, 253, 901, 911; 150/110

[56] References Cited

U.S. PATENT DOCUMENTS

| | | | |
|---|---|---|---|
| 1,828,342 | 10/1931 | Sachs | 150/110 |
| 3,347,299 | 10/1967 | Alexander | 224/202 |
| 4,140,164 | 2/1979 | Staup | 150/110 |
| 4,258,871 | 3/1981 | McMahon | 224/243 |
| 4,480,776 | 11/1984 | Atkins, Sr. | 224/243 |
| 4,515,300 | 5/1985 | Cohen | 224/253 |
| 4,750,655 | 6/1988 | Barry | 224/243 |

FOREIGN PATENT DOCUMENTS

| | | | |
|---|---|---|---|
| 624295 | 12/1977 | Switzerland | 224/224 |

OTHER PUBLICATIONS

Sep., 1984 Fire Power magazine, pp. 1, 5, 68, 69, 75.

Tactical Enterprises Inc. brochure "New Items Price List" item BT110 document A000102 (not admitted to be prior art) (No Date).

*Primary Examiner*—Henry J. Recla
*Assistant Examiner*—Glenn T. Barrett
*Attorney, Agent, or Firm*—Nixon & Vanderhye

[57] ABSTRACT

A hand gun in a holster is completely concealed by a simulated carrying pouch. A backing is mounted on a wearer, as with a belt around the wearer's waist. A holster is mounted on the backing completely within the area defined by the top, bottom and ends of the backing. A flap, permanently attached at the bottom to the backing but releasably attached by hook and pile fasteners (VELCRO ®) at the top and two ends of the backing defines a textile material (fabric) or leather container which simulates a carrying pouch and completely conceals the holster and hand gun. Pockets may be provided in the flap. The holster is reversibly mounted on the backing using hook and pile fasteners, and hook and pile fastener straps releasably hold the hand gun within the holster. To gain access to the hand gun, the hook and pile fasteners at the top and two ends of the backing and flap are detached to completely expose the handgun for ready access.

14 Claims, 2 Drawing Sheets

FIG. 1
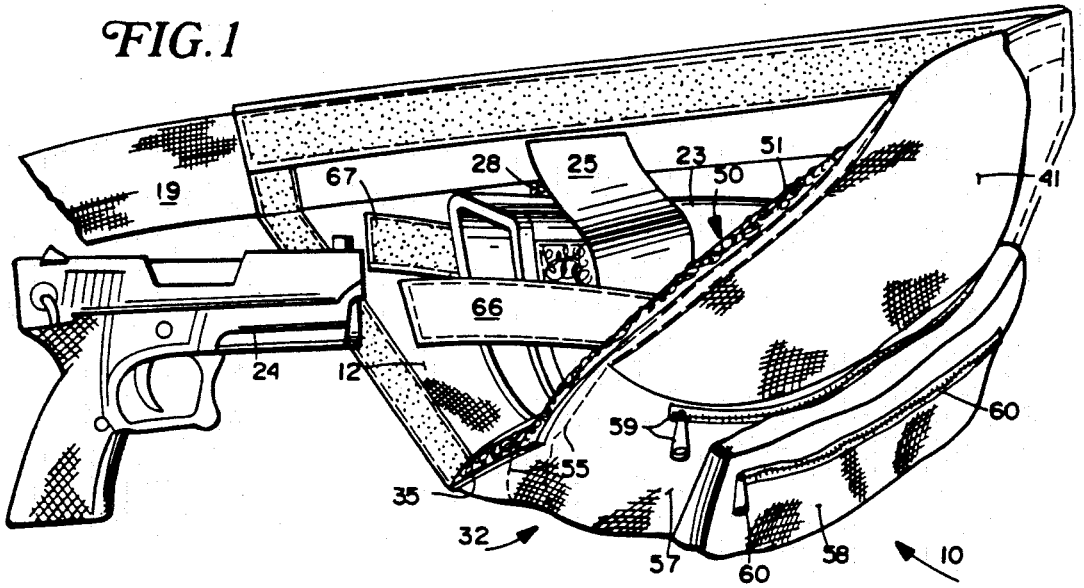
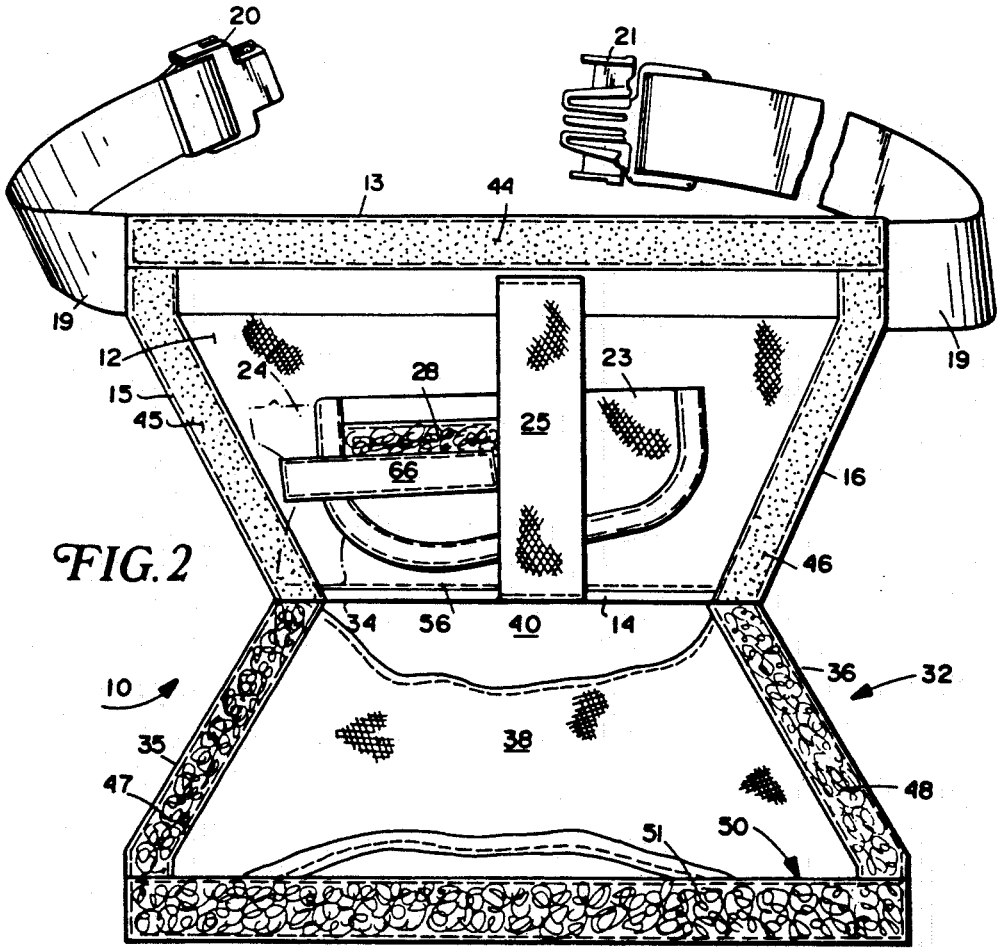
FIG. 2

SIMULATED POUCH WITH INTERIOR, CONCEALED HOLSTER

This is a continuation of application Ser. No. 07/435,172, filed Nov. 13, 1989, now U.S. Pat. No. 4,966,320.

BACKGROUND AND SUMMARY OF THE INVENTION

There are many situations when a person authorized to carry a hand gun wants to completely conceal the hand gun. For example undercover policemen, couriers, plainclothes security guards, and the like oftentimes have need to completely conceal a hand gun in situations where they are not wearing a jacket, and without providing significant discomfort. However while concealment of the hand gun is desirable, the wearer must have ready access to the hand gun in emergency situations.

According to the present invention, an assembly is provided that allows a wearer to completely hide a hand gun on his/her person yet position the hand gun so that it is readily accessible for a "quick draw". This is provided according to present invention by utilizing a simulated carrying pouch assembly, which looks like a conventional carrying pouch often worn by men and women as a utilitarian article of fashion. However the simulated carrying pouch assembly has the outer portion thereof readily detachable from the inner portion to expose a holster and hand gun mounted on the interior thereof. The simulated carrying pouch assembly can be attached by a belt to the wearer's waist, or may be attached by a shoulder strap or the like.

According to one aspect of the present invention, a simulated carrying pouch assembly is provided comprising: A backing having a top, bottom, and two ends. A flap having a top, bottom, and two ends, with a central portion between the top, bottom, and two ends, with an excess of material forming the flap so that the central portion of the flap defines a container adapted to stand out from the backing. Readily releasable fastener means attaching the flap top and ends to the backing top and ends, respectively. Means for attaching the flap bottom to the backing bottom. Means for mounting the backing on a wearer. Means for mounting a holster, capable of holding a hand gun, on the backing completely within the area defined by the top, bottom, and ends thereof, and within the container defined by the flap when the flap top, bottom, and ends are in engagement with the backing top, bottom, and ends. And, a holster adapted to be mounted by the holster mounting means.

The readily releasable fastener means preferably comprise hook and pile fasteners ("VELCRO®") on the exterior of the backing ends, and interior of the flap ends. The flap bottom is preferably permanently attached to the backing bottom. The flap is preferably formed of a textile material (fabric), such as nylon, and the excess material therein is provided by fabric inserts. The flap has permanent attachment simulating means (stitching) formed at the exterior of the ends thereof, and a sub-flap at the top having part of a hook and pile fastener system formed on the exterior thereof and adapted to be bent over to engage the other part of a hook and pile fastener system at the backing top.

According to another aspect of the present invention a holster mounting system is provided for reversibly mounting a holster. The system comprises: A backing having a top and a bottom. Means for mounting the backing on a wearer. A first strip of hook and pile fastening material of one type extending from the top to the bottom at a central portion of the backing. A loop of textile material connected adjacent the backing top and bottom overlying the first strip, and having an interior surface with the one type of the hook and pile fastening material. A holster having opposite sides and an open end. And, hook and pile fastening material strips of the other type disposed on the opposite sides of the holster for cooperating with the first strip and the loop for removably mounting the holster on the backing. Straps are preferably provided for releasably holding the gun in the holster at the open end thereof. One of the straps has hook and pile fasteners of one type disposed substantially along the entire length thereof, while the strap has hook and pile fasteners of one type disposed along about half the length thereof, and of the other type along the other approximately half thereof. Thus each strap cooperates with the fasteners on the holster sides, and with each other, to releasably hold the hand gun in the holster.

The holster is reversibly mounted on the backing so that it may be readily drawn by either a left handed or right handed wearer regardless of the exact positioning of the backing on the wearer's body.

According to yet another aspect of the present invention, a method is provided for concealing a hand gun yet allowing ready access thereof. The method comprises the steps of: Reversibly mounting a holster on a backing. Attaching the backing to a portion of the wearer's body. Releasably connecting a simulated carrying pouch on the backing, including at least at the top and ends thereof, so as to completely conceal the hand gun and holster. And, effecting quick release of the releasable fasteners attaching the simulated carrying pouch at the top and ends of the backing, so as to quickly expose the holster and hand gun. The step of mounting the backing on the wearer is preferably accomplished utilizing a belt attaching the backing to around the wearer's waist.

It is the primary object of the present invention to provide for the effective concealment, yet ready access to, a hand gun. This and other objects of the invention will become clear from an inspection of the detailed description of the invention, and from the appended claims.

BRIEF DESCRIPTION OF THE DRAWINGS

FIG. 1 is a top perspective exploded view showing the simulated carrying pouch assembly according to the invention when the flap is being detached to expose and allow access to the hand gun and holster, and showing the hand gun removed from the holster;

FIG. 2 is a front view of the assembly of FIG. 1 with the flap completely detached along the top and ends thereof from the backing;

DETAILED DESCRIPTION OF THE DRAWINGS

Figure 3:
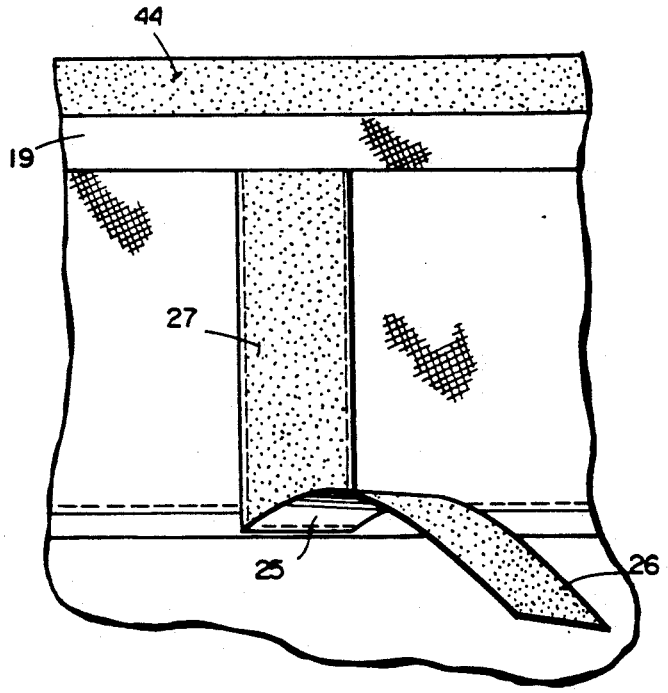
FIG. 3 is a detail exploded view showing the mechanism on the backing for releasably attaching the holster to the backing.

A simulated pouch carrying assembly according to the invention is shown generally by reference numeral 10 in FIGS. 1 and 2. One of the main components of the assembly 10 is the backing 12 which has a top 13, bottom 14. and two ends 15 and 16 (FIG. 2). The backing 12 is preferably mounted on the wearer's body at a convenient or "fashionable" position, as by utilizing a textile material belt 19 which has female 20 and male 21 fasteners at the ends thereof, the fasteners 20, 21 being conventional. While a belt 19 is shown, a shoulder strap, or other attachment device for mounting the backing 12 on the wearer, may be provided.

A holster 23 adapted to be mounted on the backing 12 is also provided, for holding a hand gun 24. The holster 23, which may be made of a textile material such as nylon, or leather, is adapted to be mounted on the backing 12 preferably in a reversible manner so that it may be readily accessed and utilized by a left handed or a right handed person. A strap of fabric material 25 is attached (as by permanent stitching) at the top and bottom thereof to the backing adjacent to the top 13 and bottom 14 of the backing 12. The interior face of the strap or loop 25, which preferably is of textile material such as nylon has one component of a hook and pile fastening system 26 formed on the interior surface thereof, and overlying a strip 27 of a preferably like component of a hook and pile fastening system 27 attached directly to the backing 12. For example both the interior surface 26 of the loop 25 and the material 27 (see FIG. 3) may be the hook component of a VELCRO® fastening system. The elements 26, 27 cooperate with pieces of material 28, 28' (see FIG. 4) associated with the holster 23, the portions 28, 28' for example being pile components of a VELCRO® fastening system.

The backing 12 may be made of a wide variety of materials. One particularly useful manner of construction, however, is to provide a flexible sheet of relatively stiff material, such as cardboard or reinforcing plastic, and cover it with fabric, and stitch, or otherwise attach, the belt 19 at the top thereof. The top of the loop 25 is then actually stitched to the belt 19. If the backing 12 is of leather, a reinforcing plastic or cardboard sheet is not necessary since backing 12 will be relatively rigid on its own.

The assembly 10 further comprises a flap 32 which has a top 33, bottom 34, and ends 35 and 36. A central portion 38 is provided between the top, bottom, and ends, 33-36, with excess material forming the flap. The excess material may be in the form of fabric inserts 40, 41 stitched to the central portion 38 and other portions of the flap 32. The flap 32 preferably is made of a textile material, such as nylon, and it may have waterproofing coating on the interior thereof. Alternatively it could be made of leather (including inserts 40, 41). A central portion 38-, with fabric inserts 40, 41, defines a container adapted to stand out from the backing 12 and completely conceal the hand gun 24 in the holster 23 therewithin.

Note that the holster 23 and the holster mounting means 25, etc. mount the holster 23 and gun 24 so that they are completely within the area defined by the top, bottom, and ends 13 through 16 of the backing 12 (see FIGS. 1 and 2).

The assembly 10 further comprises readily releasable fastening means for attaching the flap top 33 and ends 35, 36 to the backing top 13 and ends 15, 16, respectively, to define a simulated pouch while allowing ready access to the gun 24 mounted on the backing 12. The readily releasable fastener means preferably comprise strips 44, 45, and 46 of one component of a hook and pile fastener system (e.g. hooks) disposed along the top 13 and ends 15, 16, respectively, of the backing 12, and strips 47, 48, and 51 of the other component of a hook and pile fastener system (e.g. pile) along the ends and tops, respectively of the flap 32. The sub-flap 50 has a strip 51 of VELCRO® pile component which engages the strip 44 hook components. The sub-flap 50 is pop stitched to the flap 32 and preferably extends the width of the top 33.

As seen in FIG. 1, permanent attachment simulating means 55 are preferably formed at the exterior of the flap 32, at least at the ends 35, 36 thereof. The permanent attachment simulating means preferably comprises stitching, as illustrated at 55 in FIG. 1. However in addition to providing permanent attachment simulation, the stitching may have a utilitarian function of actually attaching the strips 47, 48 (and even 51) of the VELCRO® to the interior end surfaces of the flap 32 (or sub-flap 50). However the VELCRO® strips can be attached by other means, such as adhesive, in which case the stitching 55" performs solely a permanent attachment simulating function to make the flap 32 appear merely as a conventional carrying pouch.

The attachment at the bottoms 14, 34 of the backing 12 and flap 32 may also be by releasable fasteners, however preferably the attachment is provided by permanent fastening means, such as the stitching 56 (FIG. 2).

It is also desirable to provide one or more pockets in the flap 32, accessible from the exterior thereof. For example a first pocket 57 (FIG. 1) and a second pocket 58 may be provided, closed by zippers 59, 60, respectively. While it is desirable that the pockets 57 and 58 be useful as real pockets, for carrying ammunition or other articles, they may merely be simulated pockets and provide only a disguising function causing the flap 32 to look as much like a conventional carrying pouch as possible. In any event, it is desirable to provide the pockets 57, 58 in such a way that they are graspable by the wearer of the assembly 10, the wearer grasping the flap 32 at the pockets 57, 58 to apply a force stripping the fastener components 44 through 46 from the fastener components 47, 48 and 51 to expose the hand gun 24 and holster 23.

Figure 4:
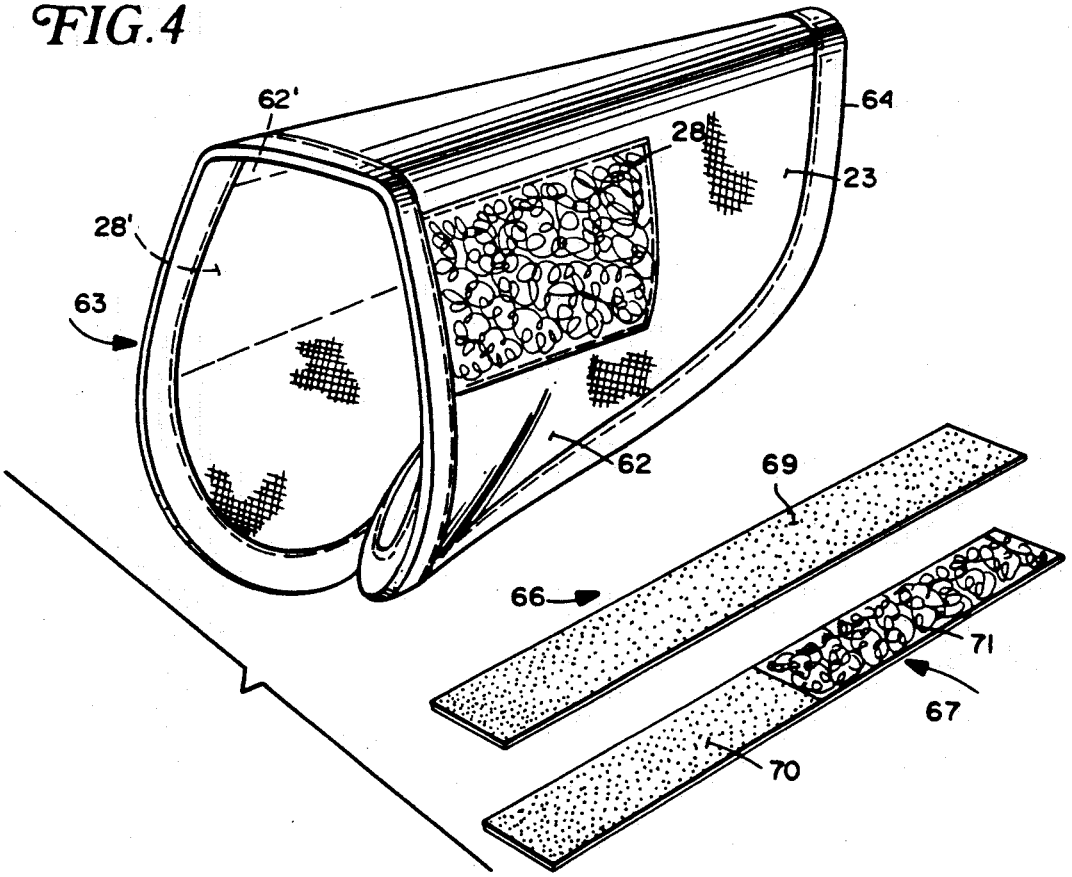
FIG. 4 is a perspective view of the holster and gun holding straps of the assembly of FIGS. 1 and 2.

The manner in which the holster 23 is mounted on the backing 12 and that the hand gun 24 is held therein is illustrated more clearly in FIG. 4. The holster 23 has opposite sides 62, 62', and an open end 63, and an end 64 opposite the open end. The end 64 may be partially open so that the muzzle of a gun may extend up to or through it, or it may be closed, depending upon the particular hand gun utilized. The holster 23 preferably is made of fabric such as nylon, with the large VELCRO® sections 28, 28' stitched or otherwise permanently attached to the sides 62, 62' respectively of the holster 23.

A pair of straps 66, 67 are provided for cooperation with the holster 23 and the gun 24 therein for releasably holding the hand gun in the holster 23. The strap 66 has on an innerface thereof a hook and pile fastener component 69 substantially along the length thereof, e.g. hooks. The strap 67, on the other hand, has one component of a hook and pile fastening system, such as hooks 70, along approximately half the length thereof, while the other fastener component, loops, 71 are provided along the approximate other half thereof. In this way the straps 66, 67 are connected at one end thereof to the VELCRO® loop sections 28, 28', and are connected at the other ends thereof (loop 71 to hook 69) to each other. The straps have a length long enough to engage both the VELCRO® sections 28, 28' and each other past the hand gun 24, as illustrated in FIG. 2.

Note that the sections 28, 28' are large enough so that they can cooperate both with straps 66, 67 and the fastener components 26, 27 (FIG. 3), to both releasably mount the holster 23 on the backing 12, and hold the gun 24 within the holster 23.

In the typical method of utilization of the assembly 10, the user inserts the hand gun 24 in the holster 23, and puts the straps 66, 67 into engagement with the VELCRO® sections 28, 29, and the loops 71 in engagement with the hooks 69 at the opposite end of the hand gun 24 from the holster 23, to releasably hold the hand gun 24 within the holster 23. Then the holster 23 is inserted between the loop 25 and backing 12, in either direction depending upon whether the wearer is left handed or right handed and where the assembly 10 will be mounted on the wearer's body, so that the loops of the sections 28, 28' engage the hooks of the sections 26, 27. The holster 23 is thus releasably mounted on the backing 12, and the holster 23 and hand gun 24 are completely within the area defined by the top, bottom, and ends 13 through 16 of the backing 12.

After the holster 23 is mounted on the backing 12, the wearer pivots the flap upwardly about the bottom portions 14, 34 of the backing 12 and flap 32, respectively, and presses the VELCRO® strips 47, 45 into contact with each other, and the strips 48, 46 into contact with each other. At the top, the VELCRO® portion 51 of sub-flap 50 is pressed into engagement with the VELCRO® strip 44. The assembly 10 so positioned completely simulates a conventional carrying pouch, which is well known as a utilitarian

What is claimed is:

1. A simulated carrying pouch assembly comprising:

a backing having a top, bottom, and two ends;

means defining a flexible material container standing out from said backing, to define a volume, and having a top;

fastener means at the top of the container for allowing access to the backing:

means for mounting said back on a wearer;

means for mounting a holster, capable of holding a hand gun, on said backing completely within the volume defined by said container;

said container, when said fastening means is opened, allowing ready access to said holster;

wherein said container simulates a carrying pouch so as to fully conceal the fact that a gun is mounted therein; and wherein said fastener means also extends along at least one end of said container to allow access to said backing at the top and at least one end of said backing.

2. An assembly as recited in claim 1 wherein said holster is attached to said backing by hook and pile fasteners.

3. An assembly as recited in claim 2 wherein said container accurately simulates a conventional waist carrying pouch worn by men and women as a utilitarian article of fashion, and includes a waist strap as said means for mounting said backing on a wearer.

4. An assembly as recited in claim 1 wherein said container accurately simulates a conventional waist carrying pouch worn by men and women as a utilitarian article of fashion, and includes a waist strap as said means for mounting said backing on a wearer.

5. An assembly as recited in claim 1 wherein said fastener means comprises hook and loop fasteners disposed at the top of said container and along at least one end thereof.

6. An assembly as recited in claim 1 wherein said fastener means extends along two ends of said container to allow access to said backing at the top and at two ends of said backing.

7. An assembly as recited in claim 6 wherein said fastener means comprises hook and loop fasteners disposed at the top of said container and along two ends thereof.

8. A simulated carrying pouch assembly comprising:

a backing having a top, bottom, and two ends;

means defining a flexible material container standing out from said backing, to define a volume, and having a top;

fastener means at the top of the container for allowing access to the backing;

means for mounting said backing on a wearer;

means for mounting a hand gun, on said backing completely within the volume defined by said container;

said container, when said fastening means is opened, allowing ready access to a hand gun mounted within said container;

wherein said container simulates a carrying pouch so as to fully conceal the fact that a gun is mounted therein; and wherein said fastener means also extends along at least one end of said container to allow access to said backing at the top and at least one end of said backing.

9. An assembly as recited in claim 8 wherein said means for mounting a hand gun within said container comprises a holster attached to said backing by hook and pile fasteners.

10. An assembly as recited in claim 8 wherein said container accurately simulates a conventional waist carrying pouch worn by men and women as a utilitarian article of fashion, and includes a waist strap as said means for mounting said backing on a wearer.

11. An assembly as recited in claim 8 wherein said fastener means comprises hook and loop fasteners disposed at the top of said container and along at least one end thereof.

12. An assembly as recited in claim 8 wherein said fastener means extends along two ends of said container to allow access to said backing at the top and at two ends of said backing.

13. An assembly as recited in claim 12 wherein said fastener means comprises hook and loop fasteners disposed at the top of said container and along two ends thereof.

14. An assembly as recited in claim 12 wherein said container accurately simulates a conventional waist carrying pouch worn by men and women as a utilitarian article of fashion, and includes a waist strap as said means for mounting said backing on a wearer.

* * * * *

US005170919B1

REEXAMINATION CERTIFICATE (3707th)

United States Patent [19] [11] B1 5,170,919

DeSantis et al. [45] Certificate Issued Jan. 19, 1999

[54] SIMULATED POUCH WITH INTERIOR, CONCEALED HOLSTER

[75] Inventors: Eugene DeSantis, 149 Denton Ave., New Hyde Park, N.Y. 11040; Mitchell Bloom, New Hyde Park, N.Y.

[73] Assignee: Eugene DeSantis, New Hyde Park, N.Y.

Reexamination Request:
No. 90/004,336, Aug. 20, 1996

Reexamination Certificate for:

| | |
|---|---|
| Patent No.: | **5,170,919** |
| Issued: | **Dec. 15, 1992** |
| Appl. No.: | **603,396** |
| Filed: | **Oct. 26, 1990** |

Related U.S. Application Data

[63] Continuation of Ser. No. 435,172, Nov. 13, 1989, Pat. No. 4,966,320.

[51] Int. Cl.[6] ..... A45C 1/04

[52] U.S. Cl. ..... 224/587; 224/192; 224/196; 224/238; 224/243; 224/676; 224/901.4; 224/901.6; 224/901.8; 224/911; 224/931

[58] Field of Search ..... 224/911, 912, 224/908, 153, 645, 650, 652, 654, 655, 658, 676, 677, 681–684, 660, 663, 664, 587, 192, 196, 238, 243; D3/215, 222–227

[56] References Cited

U.S. PATENT DOCUMENTS

| | | | |
|---|---|---|---|
| D. 238,725 | 2/1976 | Zerobnick et al. | D3/226 |
| 3,347,299 | 10/1967 | Alexander | 224/911 |
| 4,029,243 | 6/1977 | Zerobnick et al. | 224/681 |
| 4,140,164 | 2/1979 | Staup | 150/110 |
| 4,258,871 | 3/1981 | McMahon . | |
| 4,260,004 | 4/1981 | Domke | 224/901.8 |
| 4,262,832 | 4/1981 | Perkins | 224/911 |
| 4,506,769 | 3/1985 | Franco et al. | 224/653 |
| 4,515,300 | 5/1985 | Cohen . | |
| 4,545,414 | 10/1985 | Baum | 224/908 |
| 4,724,791 | 2/1988 | McSorley | 224/406 |
| 4,883,207 | 11/1989 | McArthur | 224/153 |

OTHER PUBLICATIONS

Tactical Enterprises, Inc. Brochure, Mar. 1988.
1985 J.B. Battle Catalog, p. 5 and Price List.
*Firepower*, May, 1986, p. 10.
*Guns & Ammo*, Feb. 1987, Women & Shooting, by Jo Anne Hall, p. 58.
*American Survival Guide*, Mar. 1987, New Products, p. 14.
*Women & Guns*, Jul., 1989, "Practical Accessories: for the Woman Who Runs Alone", p. 5.
1987 DeSantis Catalog, pp. 7 and 30.
*Guns & Ammo*, Jul. 1983, p. 74.
*Street Survival Handbook*, 1984, vol. 1, No. 2, "Lethal Lady's Leather" by Mark Moritz, pp. 18–19, 5.

*Primary Examiner*—Allan N. Shoap

[57] ABSTRACT

A hand gun is a holster is completely concealed by a simulated carrying pouch. A backing is mounted on a wearer, as with a belt around the wearer's waist. A holster is mountd on the backing completely within the area defined by the top, bottom and ends of the backing. A flap, permanently attached at the bottom to the backing but releasably attached by hook and pile fasteners (VELCRO®) at the top and two ends of the backing defines a textile material (fabric) or leather container which simulates a carrying pouch and completely conceals the holster and hand gun. Pockets may be provided in the flap. The holster is reversibly mounted on the backing using hook and pile fasteners, and hook and pile fastener straps releasably hold the hand gun within the holster. To gain access to the hand gun, the hook and pile fasteners at the top and two ends of the backing and flap are detached to completely expose the handgun for ready access.

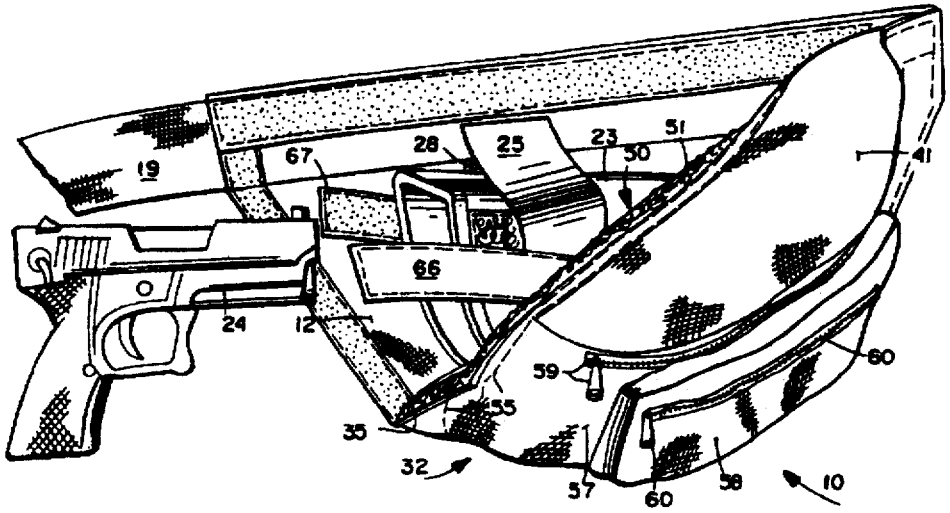

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–14 is confirmed.

* * * * *